US007833054B2

(12) United States Patent
Matsumoto

(10) Patent No.: US 7,833,054 B2
(45) Date of Patent: Nov. 16, 2010

(54) CONNECTOR

(75) Inventor: Masakazu Matsumoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/312,116

(22) PCT Filed: Jan. 30, 2008

(86) PCT No.: PCT/JP2008/051422

§ 371 (c)(1),
(2), (4) Date: Apr. 27, 2009

(87) PCT Pub. No.: WO2008/093739

PCT Pub. Date: Aug. 7, 2008

(65) Prior Publication Data

US 2010/0022122 A1 Jan. 28, 2010

(30) Foreign Application Priority Data

Feb. 1, 2007 (JP) ..... 2007-023244

(51) Int. Cl.
*H01R 9/05* (2006.01)

(52) U.S. Cl. ..... 439/582; 439/585

(58) Field of Classification Search ..... 439/581, 439/582, 584

See application file for complete search history.

(56) References Cited

U.S. PATENT DOCUMENTS 5,569,049 A 10/1996 Tatebe et al.

FOREIGN PATENT DOCUMENTS

| | | |
|---|---|---|
| JP | 7-106002 | 4/1995 |
| JP | 8-022851 | 1/1996 |
| JP | 11-026037 | 1/1999 |

OTHER PUBLICATIONS

International Search Report, Mar. 2008.

*Primary Examiner*—Briggitte R Hammond
(74) *Attorney, Agent, or Firm*—Collard & Roe, P.C.

(57) ABSTRACT

An insulative housing 21 holding a conductive contact 11 is provided with a receiving portion 26 for receiving an electric wire 51. The contact is provided with a connecting portion 13 disposed in the receiving portion. When the electric wire is received in the receiving portion, the electric wire is electrically connected to the connecting portion of the contact.

14 Claims, 5 Drawing Sheets

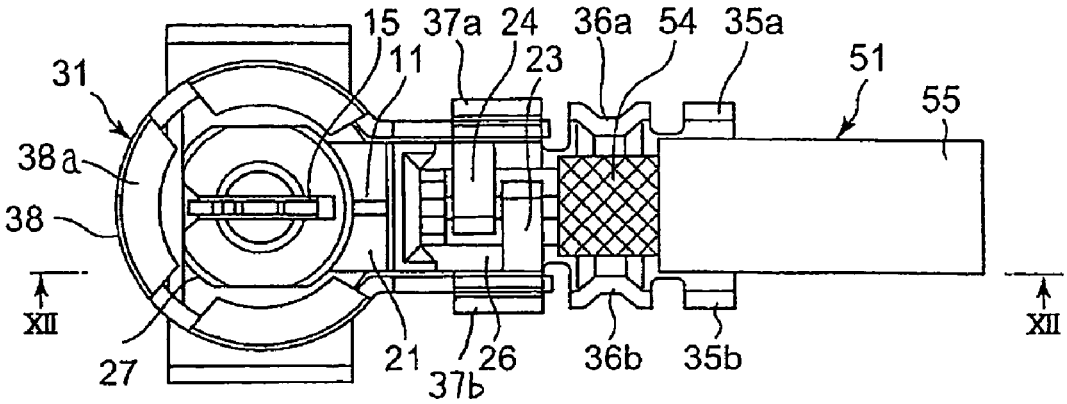
FIG. 11
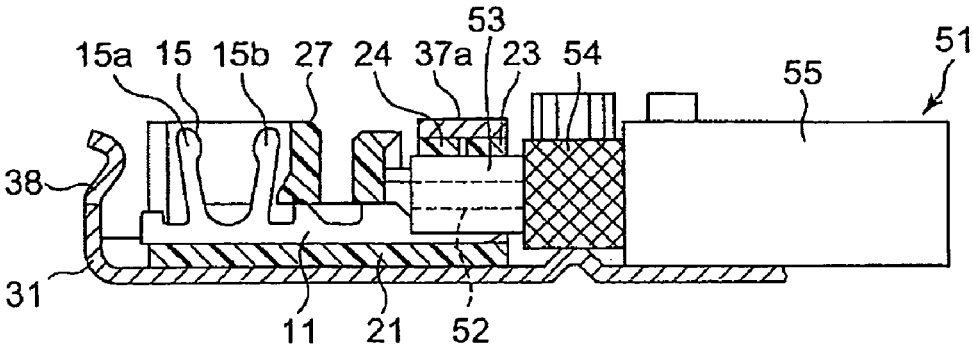
FIG. 12
FIG. 13
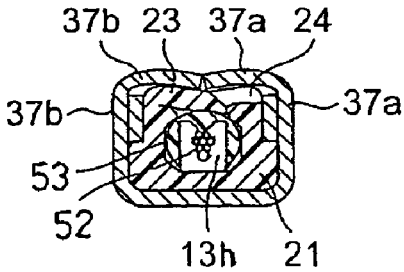
FIG. 14
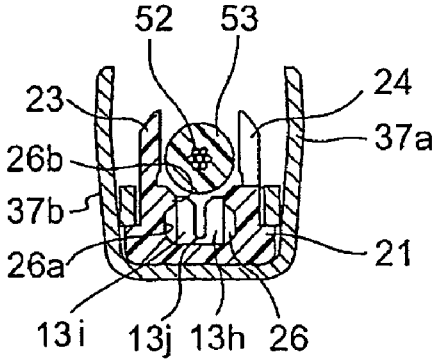

CONNECTOR

TECHNICAL FIELD

This invention relates to a connector to be connected to an electric wire.

BACKGROUND ART

For example, Patent Document 1 (Japanese Unexamined Patent Application Publication (JP-A) No. H8-22851) discloses a coaxial plug connector having a simple press-crimping portion provided with contacting parts which penetrate an outer sheath of a coaxial cable to be brought into contact with an external conductor braid of the coaxial cable. Further, in the coaxial plug connector, a contact cuts through a dielectric member to be brought into contact with a central conductor.

Further, Patent Document 2 (Japanese Unexamined Patent Application Publication (JP-A) No. H11-26037) discloses a terminal having a connecting portion provided with a blade portion biting into a coating portion of a coated wire. Specifically, on the inside of sidewalls rising from both side edges of a conductive substrate, a plurality of angular pillars rising from the conductive substrate are arranged zigzag in a longitudinal direction of the conductive substrate. Each of the angular pillars has a slant surface formed on its end and the above-mentioned blade portion is formed at a corner portion between the slant surface and an inner wall surface of the angular pillar. The angular pillars are arranged so that a conductor portion of the coated wire is elastically deformed in a meandering manner to be brought into press contact with the angular pillars by an elastic force when the coated wire is inserted between the both sidewalls.

[Patent Document 1] Japanese Unexamined Patent Application Publication (JP-A) No, H8-22851

[Patent Document 2] Japanese Unexamined Patent Application Publication (JP-A) No. H11-26037

DISCLOSURE OF THE INVENTION

Problem to be Solved by the Invention

In Patent Document 1, the simple press-crimping portion is pressed by an upper jig and a lower jig. The simple press-crimping portion is curled by the upper jig to bite into the outer sheath of the coaxial cable. On the other hand, the contacting parts of the simple press-crimping portion penetrate the outer sheath of the coaxial cable to be brought into contact with the external conductor braid. Accordingly, the simple press-crimping portion may be deformed. Therefore, it is difficult to guide the coaxial cable to a position appropriate for press contact. Thus, there is a problem that displacement of the coaxial cable is caused.

In Patent Document 2, since sidewalls of the conductive substrate are thin, the sidewalls of the conductive substrate may be deformed when the angular pillars bite into the coating portion of the coated wire. Therefore, the conductor portion of the coated wire can not be guided to a contacting position with the angular pillars. Thus, there is a problem that loose connection occurs.

It is therefore an exemplary object of the present invention to provide a connector capable of reliably and easily connecting a contact to an electric wire and improving connection reliability.

It is another exemplary object of the present invention to provide a connector which simplifies a process of connecting a contact to an electric wire, which can be reduced in size, and which is excellent in transmission characteristic or high-frequency characteristic.

Means to Solve the Problem

According to an exemplary aspect of the present invention, there is provided a connector to be connected to an electric wire, comprising a contact and a housing holding the contact, wherein the contact comprises a connecting portion to be connected to a core wire of the electric wire, the housing comprises a covering portion which covers the electric wire and presses the electric wire toward the connecting portion to connect the core wire to the connecting portion, and a receiving portion for receiving the electric wire, the connecting portion is received in the receiving portion, and the receiving portion comprises a positioning portion for positioning the electric wire.

According to another exemplary aspect of the present invention, there is provided a connector to be connected to an electric wire, comprising an insulative housing and a conductive contact held by the housing, wherein the housing comprises a receiving portion for receiving the electric wire, and the contact comprises a connecting portion which is disposed in the receiving portion to be electrically connected to the electric wire.

Effect of the Invention

According to the exemplary aspect of the present invention, it is possible to provide a connector capable of reliably and easily connecting a contact to an electric wire and improving connection reliability.

According to the another exemplary aspect of the present invention, it is possible to provide a connector which simplifies a process of connecting a contact to an electric wire, which can be reduced in size, and which is excellent in transmission characteristic or high-frequency characteristic.

BRIEF DESCRIPTION OF THE DRAWINGS

FIG. 11 is a view for describing the method of connecting the electric wire to the connector shown in FIG. 4, which is a plan view showing a state where the electric wire is connected to the connector.

FIG. 12 is a sectional view taken along a line XII-XII in FIG. 11.

FIG. 13 is a sectional view, similar to FIG. 3, of a connector according to a second embodiment of the present invention.

FIG. 14 is a sectional view, similar to FIG. 10, of the connector shown in FIG. 13.

BEST MODE FOR EMBODYING THE INVENTION

Figure 1:
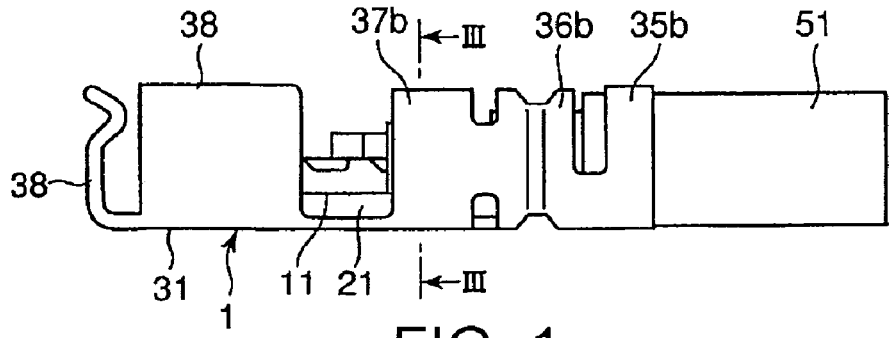
FIG. 1 is a front view showing a connector according to a first exemplary embodiment of the present invention in a wire connection state.
Figure 2:
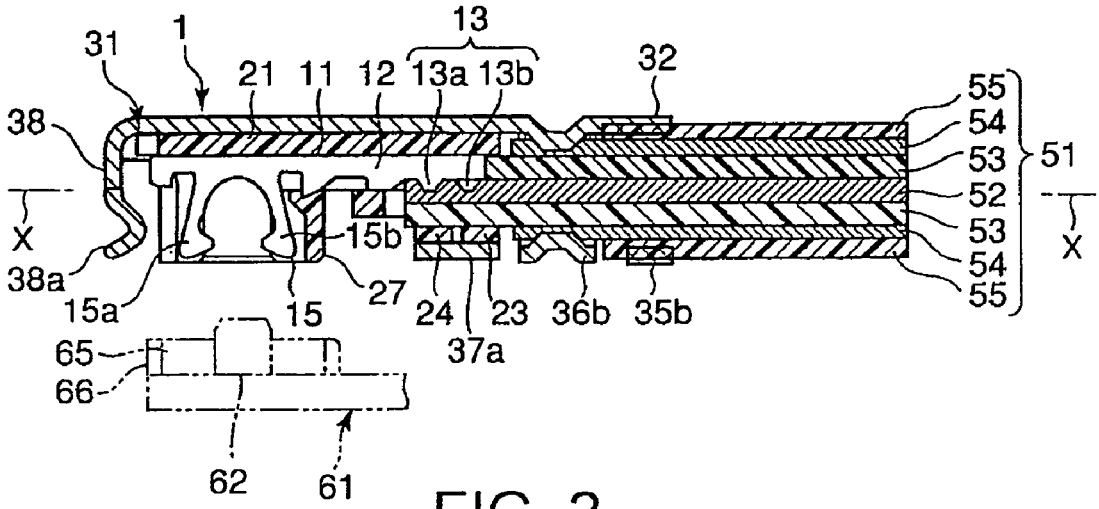
FIG. 2 is a longitudinal-sectional front view in the wire connection state in FIG. 1.
Figure 3:
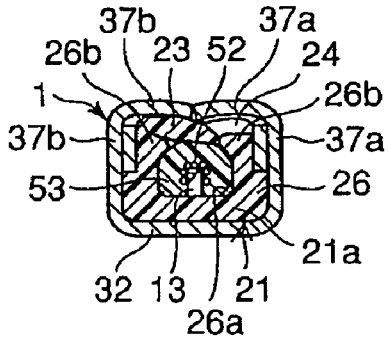
FIG. 3 is a sectional view taken along a line III-III in FIG. 1.
Figure 4:
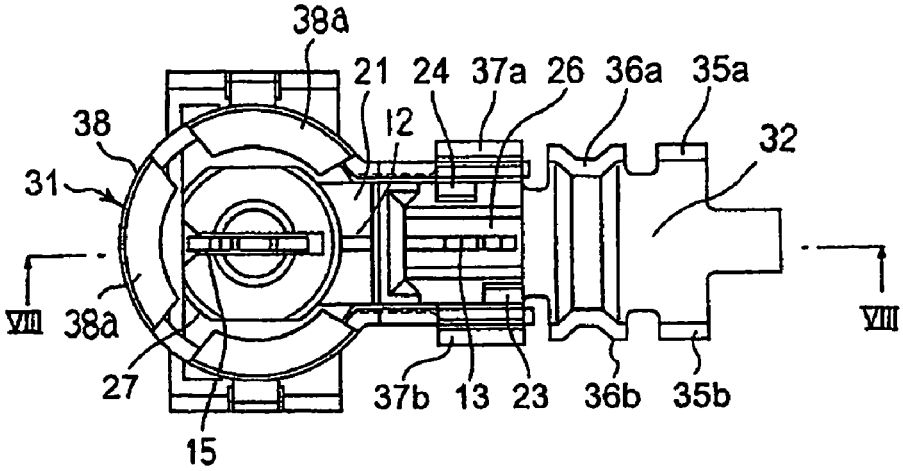
FIG. 4 is a plan view showing the connector illustrated in FIG. 1 but in a wire non-connection state.

Referring to FIGS. 1 through 4, a connector according to a first exemplary embodiment of the present invention will be described.

The connector is denoted by a reference numeral 1 and an electric wire 51 is connected thereto. The connector 1 has a conductive contact 11, an insulative housing 21 holding the contact 11, and a conductive outer contact 31 disposed outside the housing 21. The electric wire 51 comprises a coaxial cable and has a core wire 52, a dielectric member 53 covering the core wire 52, an outer conductor 54 covering the dielectric member 53, and an insulative outer sheath 55 covering the outer conductor 54.

The contact 11 has a generally long-plate-like base portion 12, a connecting portion 13 formed near one end portion of the base portion 12 in an axial direction, namely, a center axis X direction, so as to be connected to the core wire 52 of the electric wire 51, and a contacting portion 15 formed near the other end portion of the base portion 12 in the center axis X direction. The connecting portion 13 has two press-contacting blades 13*a* and 13*b* in the form of projections which project from one side of the base portion 12 parallel to a longitudinal direction of the base portion 12, and which are shifted in position from each other in the center axis X direction.

Figure 5:
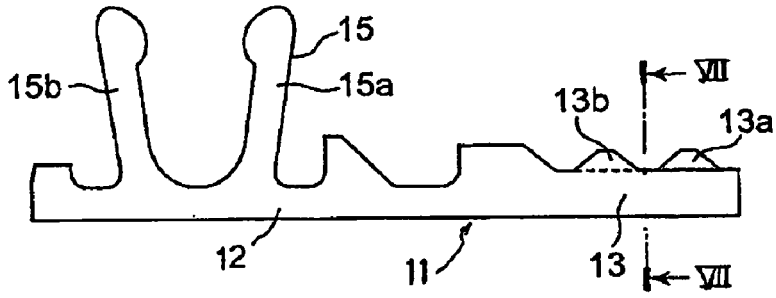
FIG. 5 is an enlarged front view of a contact included in the connector in FIG. 4.
Figure 6:
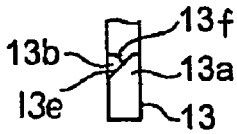
FIG. 6 is a right side view of the contact shown in FIG. 5.
Figure 7:
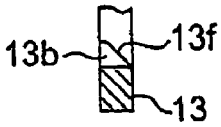
FIG. 7 is a sectional view taken along a line VII-VII in FIG. 5.

Referring also to FIGS. 5 through 7, additional description will be made about the contact 11.

The two press-contacting blades 13*a* and 13*b* have end portions provided with tapered portions 13*e* and 13*f*, respectively, each of which is formed on a surface in a radial direction, namely, a through-thickness direction perpendicular to the center axis X direction. As seen from the right side of a sheet, the tapered portions 13*e* and 13*f* are formed in directions intersecting with each other. Specifically, one tapered portion 13*e* is formed on one side of the surfaces in the through-thickness direction while the other tapered portion 13*f* is formed on another side of the surfaces in the through-thickness direction. Incidentally, as will be understood from FIGS. 6 and 7, the tapered portions 13*e* and 13*f* are formed within a range of a through-thickness dimension of the contact 11.

The contacting portion 15 has a pair of spring parts 15*a* and 15*b* extending from the one side of the base portion 12 so as to face each other. Each of the spring parts 15*a* and 15*b* has a through-thickness dimension same as that of the contact 11.

Returning to FIGS. 1 through 4, the housing 21 has a pair of covering portions 23 and 24 serving as an operating portion and formed near one end portion in the center axis X direction in order to electrically connect the connecting portion 13 to the core wire 52 of the electric wire 51, a receiving portion 26 formed adjacent to the pair of covering portions 23 and 24 in order to receive the electric wire 51, and a generally groove-like fitting portion 27 formed near the other end portion in the center axis X direction. The receiving portion 26 defines a receiving area 28*b* having an opening portion 28*a* capable of receiving a part of the electric wire 51, i.e., a part in an axial direction, from its radial direction. The connecting portion 13 of the contact 11 is disposed in the receiving area 28*b*. The connecting portion 13 is positioned in an area corresponding to an intermediate position between a pair of end portions opposite to each other and defining the opening portion 28*a*.

The receiving portion 26 has a first positioning portion 26*a* having a generally U-shaped section for receiving a dielectric member 53 part of the electric wire 51, and a pair of second positioning portions 26*b* for pressing the dielectric member 53 part against the first positioning portion 26*a*. The first positioning portion 26*a* is formed by inner wall portions of the receiving portion 26. The second positioning portions 26*b* comprise projecting portions projecting from the wall portions of the receiving portion 26, respectively, in a direction towards each other so as to define the opening portion 28*a*.

The pair of inner wall portions constituting the first positioning portion 26*a* having a generally U-shaped section are arranged with a space slightly smaller than a diameter of the dielectric member 53. Further, the second positioning portions 26*b* are arranged with a space which is set to be smaller than that between the pair of inner wall portions of the receiving portion 26. A height dimension from an inner surface of the first positioning portion 26*a* having a generally U-shaped section to a portion where the pair of second positioning portions 26*b* are brought into contact with the dielectric member 53 is slightly smaller than a diameter of the dielectric member 53 part of the electric wire 51.

The contacting portion 15 of the contact 11 is positioned in the fitting portion 27. Between the pair of spring parts 15*a* and 15*b* of the contacting portion 15, a mating contact portion 62 disposed in a mating connector 61 shown in FIG. 1 is inserted and fitted to thereby establish connection. The mating connector 61 is provided with a mating fitting portion 65 to receive the fitting portion 27. The mating fitting portion 65 has a mating outer contact 66 disposed on a periphery thereof and adapted to be connected to the outer contact 31.

The outer contact 31 has a pair of outer sheath holding portions 35*a* and 35*b* formed near its one end in the center axis X direction and extending from two sides of a bottom portion 32 parallel to a longitudinal direction so as to face each other, and a pair of outer conductor holding portions 36*a* and 36*b* adjacent to the pair of outer sheath holding portions 35*a* and 35*b* with a space kept therefrom and extending from the two sides of the bottom portion 32 parallel to the longitudinal direction so as to face each other.

Further, the outer contact 31 has a pair of dielectric member holding portions 37*a* and 37*b* adjacent to the outer conductor holding portions 36*a* and 36*b* with a space kept therefrom and extending from the two sides of the bottom portion 32 parallel to the longitudinal direction so as to face each other, and a generally cylindrical fitting frame portion 38 adjacent to the dielectric member holding portions 37*a* and 37*b* with a space kept therefrom and extending from the bottom portion 32 in a generally tubular shape.

Inside the pair of dielectric member holding portions 37*a* and 37*b*, the covering portions 23 and 24 of the housing 21 are positioned. The bottom portion 32 formed adjacent to the pair of dielectric member holding portions 37*a* and 37*b* is positioned so as to face a housing bottom portion 21*a* of the receiving portion 26.

The fitting frame portion 38 has a front-end side provided with spring projecting portions 38*a* projecting so as to face the fitting portion 27. In the fitting frame portion 38, an inner surface of each of the spring projecting portions 38*a* is brought into contact with an outer surface of the mating outer contact 66 of the mating connector 61 shown in FIG. 2.

As mentioned above, the connector 1 is disposed in a state where the connecting portion 13 of the contact 11 is connected to the core wire 52 of the electric wire 51 and the contact 11 is insulated from the outer contact 31 through the housing 21.

For example, the contact 11 is connected through the mating connector 61 to a circuit of a printed circuit board (not shown in the figure) on which the mating connector 61 is mounted, thereby transmitting and receiving a signal. Further, the outer contact 31 is fitted to the mating outer contact 66 to be connected to a ground circuit of the printed circuit board on which the mating connector 61 is mounted, thereby achieving a grounding function.

The contact 11 may be made by punching and pressing a conductive plate. The housing 21 may be made by forming a resin material. The outer contact 31 may be made by punching, pressing, and thereafter bending a conductive plate.

Referring also to FIGS. 8 through 12, a method of connecting the connector 1 to the electric wire 51 will be described.

Figure 8:
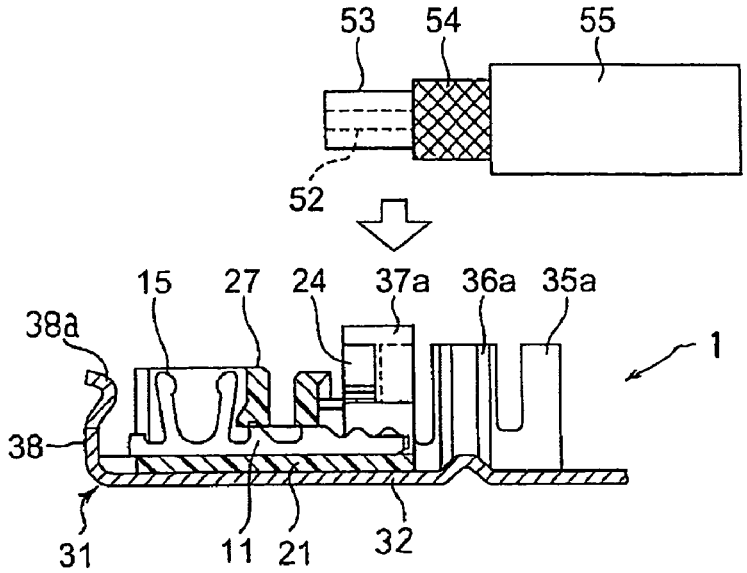
FIG. 8 is a view for describing a method of connecting an electric wire to the connector shown in FIG. 4, showing a state where the electric wire is separated from the connector.

As shown in FIG. 8, prior to connection, the outer sheath 55 and the outer conductor 54 are removed at one end portion of the electric wire 51 so that the outer conductor 54 and the dielectric member 53 are exposed. Then, a part where the dielectric member 53 is exposed is positioned so as to face an area between the covering portions 23 and 24.

Figure 9:
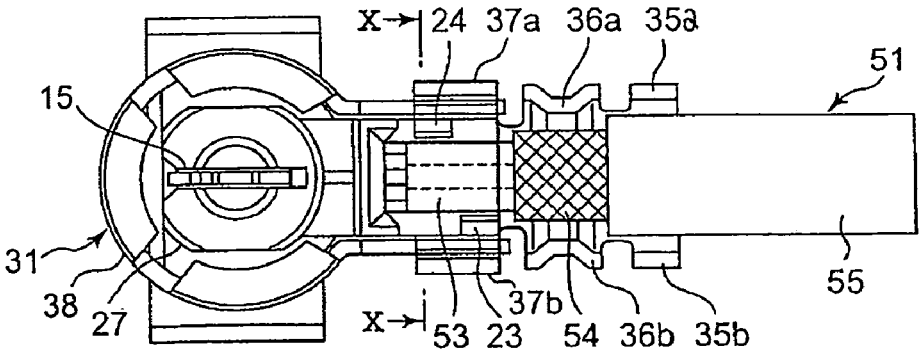
FIG. 9 is a view for describing the method of connecting the electric wire to the connector shown in FIG. 4, which is a plan view showing a state where the electric wire is set to the connector.
Figure 10:
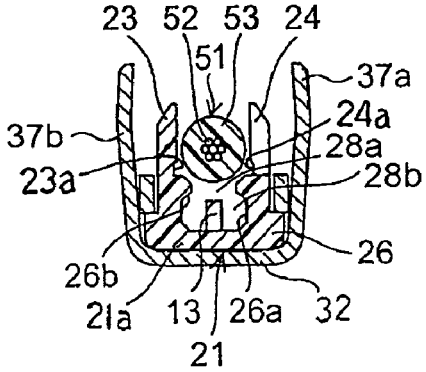
FIG. 10 is a sectional view taken along a line X-X in FIG. 9.

Next, as shown in FIGS. 9 and 10, the outer sheath 55 of the electric wire 51 is placed between the outer sheath holding portions 35*a* and 35*b*. The outer conductor 54 is positioned between the outer conductor holding portions 36*a* and 36*b*. Further, the dielectric member 53 is positioned on the receiving portion 26 of the housing 21 and between the covering portions 23 and 24.

From a state of FIG. 10, each of the covering portions 23 and 24 is bent inward and, while the dielectric member 53 is pressed by the covering portions 23 and 24, the electric wire 51 is moved in the radial direction and pressed toward the receiving area 28*b* of the receiving portion 26. While the dielectric member 53 is compressed between the second positioning portions 26*b*, the center of the two press-contacting blades 13*a* and 13*b* of the connecting portion 13 in the through-thickness direction is aligned with the core wire 52 of the electric wire 51. In this state, the electric wire 51 passes through the opening portion 28*a* to be received in the receiving area 28*b*.

As a result, the electric wire 51 is reliably held in the receiving portion 26 by the first positioning portion 26*a* and the second positioning portions 26*b*. Further, when the electric wire 51 is pressed into the receiving area 28*b*, the press-contacting blades 13*a* and 13*b* of the connecting portion 13 penetrate the dielectric member 53, as shown in FIGS. 11 and 12, to be brought into press contact with and reliably connected to the core wire 52 shown in FIG. 3.

As described in the foregoing, a dimension between the second positioning portions 26*a* and 26*b* is slightly smaller than that between the sidewall portions of the inner wall portions of the receiving portion 26 and is set to be slightly smaller than a diameter dimension of the dielectric member 53. Therefore, the core wire 52 of the electric wire 51 can be reliably guided to a position of the press-contacting blades 13*a* and 13*b*. Further, in a state where the core wire 52 is connected to the press-contacting blades 13*a* and 13*b*, the covering portions 23 and 24 firmly hold the dielectric member 53 by the first and the second positioning portions 26*a* and 26*b*.

As shown in FIG. 10, the covering portions 23 and 24 have constricted portions 23*a* and 24*a* formed thereon, respectively. With this structure, even if pressing is released after the covering portions 23 and 24 are bent inward, the covering portions 23 and 24 do not return to their original positions.

In the foregoing, the dielectric member 53 is pressed by the two covering portions 23 and 24. However, three or more covering portions may be formed in the housing 21. Further, as each of the press-contacting blades 13*a* and 13*b* of the connecting portion 13, one such element may be formed or two or more such elements may be formed adjacent to each other in the center axis X direction.

Further, as regards the electric wire 51, the outer sheath holding portions 35*a* and 35*b* are bent so as to surround and press the outer sheath 55. Thus, the outer sheath 55 is held by the outer sheath holding portions 35*a* and 35*b*. The outer conductor holding portions 36*a* and 36*b* are bent so as to surround and press the outer conductor 54. Thus, the outer conductor 54 is held by the outer conductor holding portions 36*a* and 36*b*. The dielectric member holding portions 37*a* and 37*b* are bent so as to surround and press the covering portions 23 and 24 on the receiving portion 26 of the housing 21. Thus, the dielectric member 53 is held by the dielectric member holding portions 37*a* and 37*b*.

According to the connector described above, it is possible to collectively, in other words, simultaneously press-crimp the outer sheath holding portions 35*a* and 35*b*, the outer conductor holding portions 36*a* and 36*b*, and the dielectric member holding portions 37*a* and 37*b* of the outer contact 31, the connecting portion 13 of the contact 11, and the electric wire 51 to establish connection.

Figure 15:
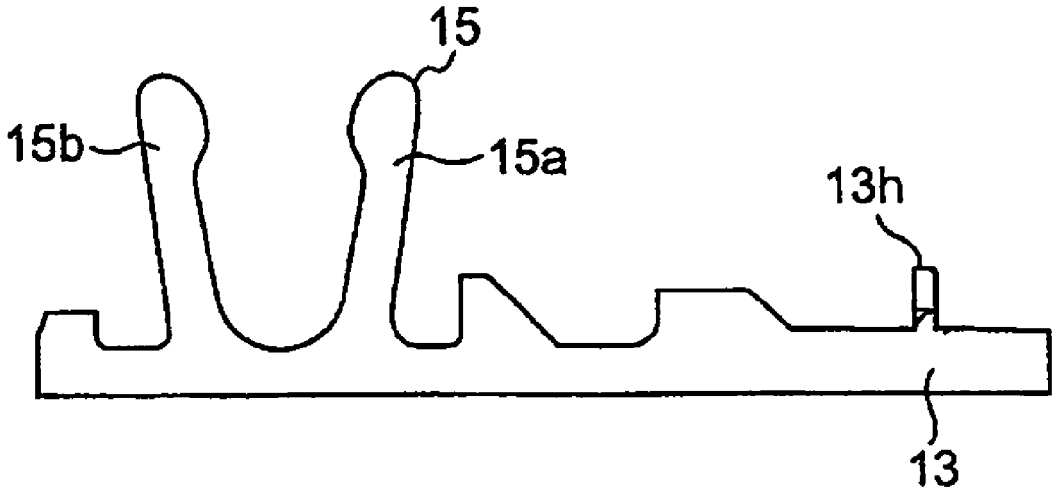
FIG. 15 is an enlarged front view of a contact included in the connector in FIGS. 13 and 14.

Referring also to FIGS. 13 to 15, a connector according to a second exemplary embodiment of the present invention will be described. Similar parts are designated by the same reference numerals and description thereof may be omitted.

The base portion 12 of the contact 11 is provided with the connecting portion 13. The connecting portion 13 has a pair of press-contacting blades 13*h* and 13*i* extending from the base portion 12. Each of the press-contacting blades 13*h* and 13*i* has a through-thickness direction formed in a direction perpendicular to a through-thickness direction of the base portion 12. Specifically, the bottom of each of the press-contacting blades 13*h* and 13*i* is twisted by an angle of 90 degrees from the base portion 12 to make the press-contacting blades 13*h* and 13*i* face each other in a radial direction of the receiving portion 26. Between the pair of press-contacting blades 13*h* and 13*i*, a slit 13*j* is formed downwards from an upper end.

Like in FIG. 9, the outer sheath 55 of the electric wire 51 is positioned between the outer sheath holding portions 35*a* and 35*b*. The outer conductor 54 is positioned in the outer conductor holding portions 36*a* and 36*b*. Further, the dielectric member 53 is positioned on the receiving portion 26 and between the covering portions 23 and 24 of the housing 21.

Next, while the covering portions 23 and 24 are bent inward, the dielectric member 53 is pressed by the covering portions 23 and 24 from a state of FIG. 14. Thus, the dielectric member 53 is pressed into and received in the receiving portion 26. As a result, the dielectric member 53 is reliably held in the receiving portion 26 by the first positioning portion 26*a* and the second positioning portions 26*b*. When the dielectric member 53 is pressed into the receiving portion 26, the press-contacting blade 13*h* penetrates the dielectric member 53 to be connected to the core wire 52 as shown in FIG. 15.

A space between the second positioning portions 26*b* is set to be smaller than that between the pair of the inner wall portions of the receiving portion 26 and is set to be slightly smaller than the diameter dimension of the dielectric member 53. Consequently, the core wire 52 of the electric wire 51 is reliably guided to the slit 13*j* between the press-contacting blades 13*h* and 13*i*.

Further, in a state where the core wire 52 is connected to the connecting portion 13 with the slit 13*j* as a center, the covering portions 23 and 24 can firmly hold the dielectric member 53 in cooperation with the first and the second positioning portions 26*a* and 26*b*.

Hereinbelow, various exemplary embodiments of the present invention will be enumerated.

1. A connector to be connected to an electric wire, comprising a contact and a housing holding the contact, wherein the contact comprises a connecting portion to be connected to a core wire of the electric wire, the housing comprises a covering portion which covers the electric wire and presses the electric wire toward the connecting portion to connect the core wire to the connecting portion, and a receiving portion for receiving the electric wire, the connecting portion is received in the receiving portion, and the receiving portion comprises a positioning portion for positioning the electric wire.

2. The connector of item 1, wherein the connecting portion comprises a pair of press-contacting blades formed in an axial direction of the electric wire, the press-contacting blades comprise tapered portions, respectively, one of the tapered portions is formed on one side perpendicular to the axial direction, and another of the tapered portions is formed on the other side perpendicular to the axial direction.

3. A connector to be connected to an electric wire, comprising an insulative housing and a conductive contact held by the housing, wherein the housing comprises a receiving portion for receiving the electric wire, and the contact comprises a connecting portion which is disposed in the receiving portion to be electrically connected to the electric wire.

4. The connector of item 3, wherein the receiving portion defines a receiving area having an opening portion adapted to receive a part of the electric wire in an axial direction from its radial direction, and the housing further comprises a movable operating portion which is connected to the receiving portion and adapted to open and close the opening portion.

5. The connector of item 4, wherein the operating portion covers that part of the electric wire in the axial direction, which is disposed in the receiving area.

6. The connector of item 4 or 5, wherein the receiving portion comprises a pair of end portions which are faced to each other and defines the opening portion, and the operating portion comprises a pair of covering portions which are connected to the pair of end portions, respectively.

7. The connector of item 6, wherein the positioning portion comprises a first and a second positioning portion which are faced to each other, and the connecting portion is disposed in an area corresponding to an intermediate position between the pair of end portions.

8. The connector of any one of items 3 through 7, wherein the receiving portion comprises a positioning portion for positioning the electric wire.

9. The connector of any one of items 3 through 8, wherein the connecting portion comprises a pair of press-contacting blades shifted in position from each other in an axial direction of the receiving portion, and the pair of press-contacting blades comprises tapered portions which are opposite to each other in a direction perpendicular to the axial direction.

10. The connector of any one of items 3 through 8, wherein the connecting portion comprise a pair of press-contacting blades which face each other in a radial direction of the receiving portion with a slit left between the pair of press-contacting blades.

Various exemplary effects of the present invention will be enumerated hereinbelow.

1. By the covering portions of the housing, the electric wire can properly be positioned and held in the positioning portions of the housing. Therefore, a process of connecting the electric wire and the contact is simplified and the core wire of the electric wire and the connecting portion of the contact can reliably and easily be connected to each other. Thus, reliability can be improved.

2. By the covering portions of the housing, the electric wire can properly be positioned and held in the positioning portions of the housing. Therefore, it is possible to provide a connector which can be reduced in size and which is excellent in transmittance characteristic or high-frequency characteristic.

INDUSTRIAL APPLICABILITY

The connector of the present invention is applicable to a case where a cable, such as a coaxial cable, having an outer sheath covering a core wire is connected to a substrate or the like inside an apparatus.

The invention claimed is:

1. A connector to be connected to an electric wire, comprising a contact and a housing holding the contact, wherein the contact comprises a connecting portion to be connected to a core wire of the electric wire, the housing comprises a covering portion which covers the electric wire and presses the electric wire toward the connecting portion to connect the core wire to the connecting portion, and a receiving portion for receiving the electric wire, the connecting portion is received in the receiving portion, and the receiving portion comprises a positioning portion for positioning the electric wire;

wherein the connecting portion comprises a pair of press-contacting blades shifted in position from each other in an axial direction of the receiving portion, and the press-contacting blades comprise tapered portions, respectively, which are opposite to each other in a direction perpendicular to the axial direction.

2. A connector to be connected to an electric wire, comprising a contact and a housing holding the contact, wherein the contact comprises a connecting portion to be connected to a core wire of the electric wire, the housing comprises a covering portion which covers the electric wire and presses the electric wire toward the connecting portion to connect the core wire to the connecting portion, and a receiving portion for receiving the electric wire, the connecting portion is received in the receiving portion, and the receiving portion comprises a positioning portion for positioning the electric wire;

wherein the connecting portion comprises a pair of press-contacting blades which face each other in a radial direction of the receiving portion with a slit left between the press-contacting blades.

3. A connector to be connected to an electric wire, comprising an insulative housing and a conductive contact held by the housing, wherein the housing comprises a receiving portion for receiving the electric wire, and the contact comprises a connecting portion which is disposed in the receiving portion to be electrically connected to the electric;

wherein the connecting portion comprises a pair of press-contacting blades shifted in position from each other in an axial direction of the receiving portion, and the press-contacting blades comprise tapered portions, respectively, which are opposite to each other in a direction perpendicular to the axial direction.

4. The connector according to claim 3, wherein the receiving portion comprises first and second positioning portions which are faced to each other for positioning the electric wire.

5. The connector according to claim 3, wherein the receiving portion defines a receiving area having an opening portion adapted to receive a part of the electric wire in an axial direction from its radial direction, and the housing further comprises a movable operating portion which is connected to the receiving portion and adapted to open and close the opening portion.

6. The connector according to claim 5, wherein the operating portion covers that part of the electric wire in the axial direction, which is disposed in the receiving area.

7. The connector according to claim 5, wherein the receiving portion comprises a pair of end portions which is faced to each other and defines the opening portion, and the operating portion comprises a pair of covering portions which are connected to the pair of end portions, respectively.

8. The connector according to claim 7, wherein the connecting portion is disposed in an area corresponding to an intermediate position between the end portions.

9. A connector to be connected to an electric wire, comprising an insulative housing and a conductive contact held by the housing, wherein the housing comprises a receiving portion for receiving the electric wire, and the contact comprises a connecting portion which is disposed in the receiving portion to be electrically connected to the electric wire;

wherein the connecting portion comprises a pair of press-contacting blades which face each other in a radial direction of the receiving portion with a slit left between the press-contacting blades.

10. The connector according to claim 9, wherein the receiving portion comprises first and second positioning portions which are faced to each other for positioning the electric wire.

11. The connector according to claim 9, wherein the receiving portion defines a receiving area having an opening portion adapted to receive a part of the electric wire in an axial direction from its radial direction, and the housing further comprises a movable operating portion which is connected to the receiving portion and adapted to open and close the opening portion.

12. The connector according to claim 11, wherein the operating portion covers that part of the electric wire in the axial direction, which is disposed in the receiving area.

13. The connector according to claim 11, wherein the receiving portion comprises a pair of end portions which is faced to each other and defines the opening portion, and the operating portion comprises a pair of covering portions which are connected to the pair of end portions, respectively.

14. The connector according to claim 13, wherein the connecting portion is disposed in an area corresponding to an intermediate position between the end portions.

* * * * *

UNITED STATES PATENT AND TRADEMARK OFFICE

CERTIFICATE OF CORRECTION

PATENT NO. : 7,833,054 B2
APPLICATION NO. : 12/312116
DATED : November 16, 2010
INVENTOR(S) : Masakazu Matsumoto It is certified that error appears in the above-identified patent and that said Letters Patent is hereby corrected as shown below:

In Column 8, line 64, (Line 6 of Claim 3) after the word "electric" please insert the word: --wire--.

Signed and Sealed this
Twenty-eighth Day of December, 2010

David J. Kappos

David J. Kappos
*Director of the United States Patent and Trademark Office*